United States Patent [19]

Point

[11] 3,951,340

[45] Apr. 20, 1976

[54] ELECTROSTATIC POWDER PROJECTION SYSTEM AND METHOD

[75] Inventor: Marcel Point, Grenoble, France

[73] Assignee: Air-Industrie, Grenoble, France

[22] Filed: Feb. 8, 1973

[21] Appl. No.: 330,589

[30] Foreign Application Priority Data

Nov. 27, 1972 France ..... 72.42701

[52] U.S. Cl. ..... 239/3; 239/15; 239/128; 317/3; 427/25; 219/76

[51] Int. Cl.[2] ..... B05B 5/02

[58] Field of Search ..... 239/3, 15, 128, 135; 317/3; 118/302, 7; 117/17, 93.4 R, 93.4 A, 93.4 NC

[56] References Cited

UNITED STATES PATENTS

| | | | |
|---|---|---|---|
| 2,926,106 | 2/1960 | Gauthier | 239/3 X |
| 3,179,784 | 4/1965 | Johnson | 117/93.4 R |
| 3,251,550 | 5/1966 | Lippert et al. | 239/3 X |
| 3,268,171 | 8/1966 | Walberg | 239/15 |
| 3,342,621 | 9/1967 | Point et al. | 117/93.4 R X |
| 3,351,285 | 11/1967 | Tholome | 239/15 |
| 3,516,608 | 6/1970 | Bowen et al. | 239/135 X |
| 3,558,052 | 1/1971 | Dunn | 239/3 |
| 3,630,441 | 12/1971 | Felici et al. | 239/15 |
| 3,764,068 | 10/1973 | Lacchia | 239/3 |

*Primary Examiner*—Robert S. Ward, Jr.
*Attorney, Agent, or Firm*—Brisebois & Kruger

[57] ABSTRACT

In an installation for the electrostatic projection of powders for coating objects, a method of improving the efficiency of projection and deposit of the said powders consists of increasing the relative humidity of the projection gas in the immediate vicinity of the projection nozzle by means of mixing the jet of gas which conveys the coating powder, at the level of the projection nozzle, with a jet of auxiliary gas previously heated and humidified by means of an appropriate liquid. In an alternative method, there is comprised the further step of reducing the temperature of the main jet of gas before this main jet is mixed with the auxiliary gas.

The apparatus for carrying the method into effect comprises the heating and humidifying devices for the auxiliary gas and a device for cooling the main gas.

4 Claims, 1 Drawing Figure

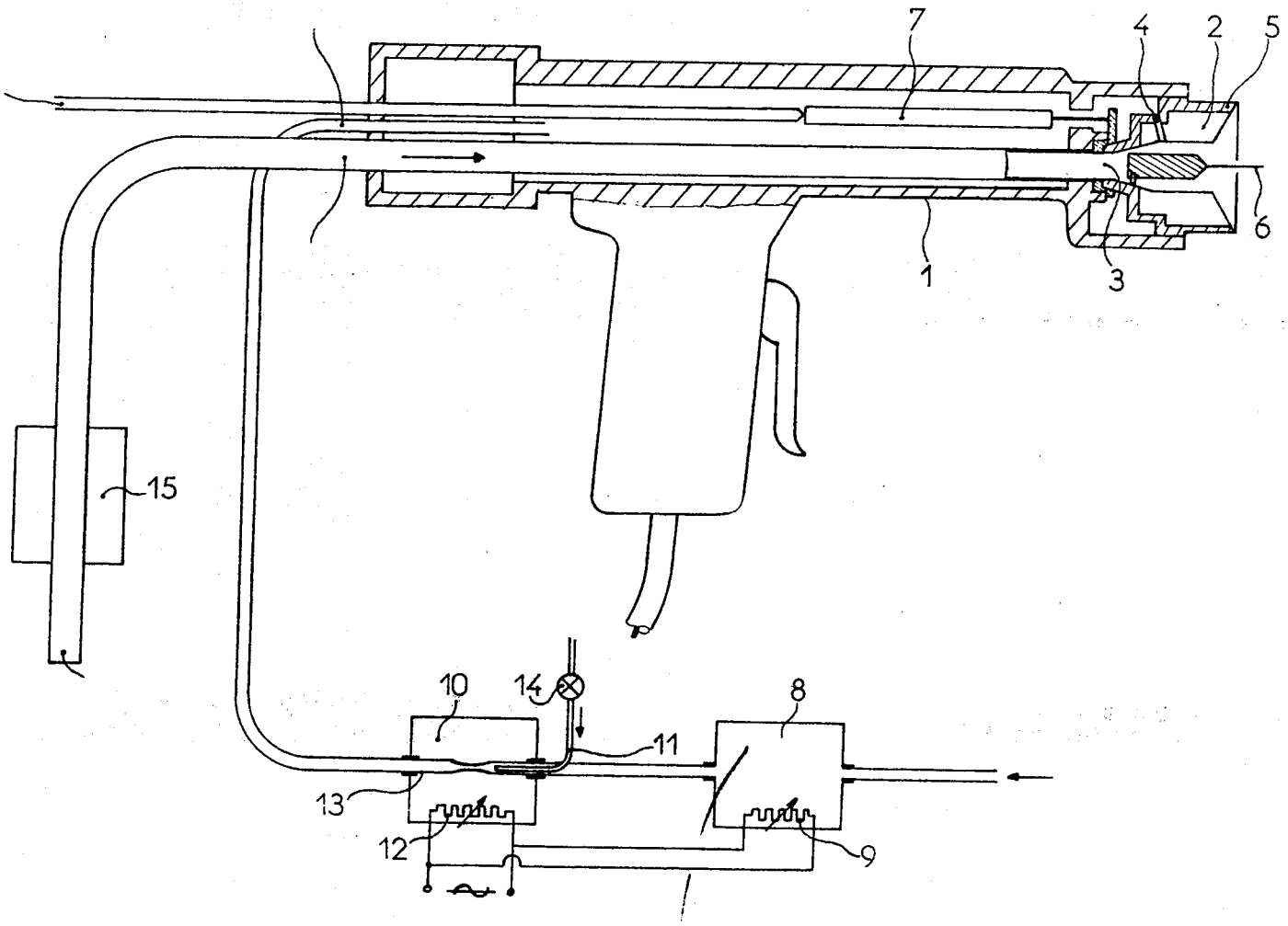
5
2
4
6
3
7
1
8
9
11
14
10
12
13
15

ELECTROSTATIC POWDER PROJECTION SYSTEM AND METHOD

The present invention relates to an improvement in methods of electrostatic projection of powders for coating objects, and also to a device which enables the said improvement to be carried into effect.

Electrostatic projection apparatus for coating powders are provided with a projection nozzle which generally has an outlet for a jet of main gas which conveys the powder, together with an outlet for a jet of auxiliary gas. Numerous experiments have recently shown that in electrostatic powdering, the projection efficiency is influenced, at a given temperature, by the relative degree of humidity in the immediate vicinity of the projection nozzle. The deposit efficiency is higher for a high relative humidity, and it has been found that, as a function of this relative humidity, there was an increase of deposit efficiency of up to 11% when the relative humidity in the vicinity of the nozzle passes from 20 to 80%.

Known methods utilized up to the present time for increasing the relative humidity in the vicinity of the projection nozzle consist of humidifying either the whole of the gas contained in the cabin or the jet of main gas which conveys the powder. The utilization of these methods is however subject to certain drawbacks. On the one hand, the method which consists of humidifying the whole of the cabin has proved extremely costly, since a powdering cabin has not only a large volume, but it is further subjected to a continuous suction, which implies bulky and expensive installations.

On the other hand, it has proved practically impossible to humidify the jet of air which conveys the powder since the powder becomes supercharged with moisture and is deposited along the intake pipes which become rapidly blocked-up.

The method according to the invention makes it possible to obtain an improvement in efficiency by the method of humidification of the surrounding gas in the vicinity of the nozzle, without encountering the difficulties of the known methods. It consists of mixing the jet of main gas conveying the powder, at the height of the projection nozzle, with a jet of auxiliary gas having a relative degree of humidity higher than that of the said jet of main gas. It is possible advantageously to obtain this higher degree of humidification by heating and then humidifying the jet of auxiliary gas, in addition to cooling the jet of main gas, if so required.

The single FIGURE of the accompanying drawing shows diagrammatically a preferred example of possible application of the method of the invention to an electrostatic powdering gun.

In the drawing, the reference 1 indicates an electrostatic powdering hand pistol. A gun of this kind comprises a projection nozzle 2 having an inlet 3 for a jet of main air conveying the powder, together with one or a number of inlets 4 for a jet of auxiliary air for dispersing the main jet. In a known manner, a high direct-current voltage, generally comprised between 60 and 90 kV is applied through a protection resistance 7 of about 100 megohms, to the metallic portions 5 and 6 located at the front of the nozzle 2 and serving as discharge electrodes.

Apart from the metallic periphery 5 and the central point 6, the front body of the nozzle is made of an insulating material such as "DELRIN".

According to the invention, the jet of auxiliary air, previously brought up to a high temperature, for example of the order of 50°to 100° centigrade, is given a very high degree of relative humidity. The mixture of this hot and very humid auxiliary air with the high and relatively cold air which conveys the powder is thus given a high relative humidity.

For this purpose, the jet of secondary air is passed, before its injection into the gun, into a heater 8 constituted by a chamber comprising a heating resistance 9 supplied from the alternating current supply mains, and then into a humifidier comprising a chamber 10 also containing a heating resistance 12 and an adjustable injection of a liquid such as water through an inlet 11 for liquid into a conduit 13 passing through the chamber 10.

The liquid supply conduit 11 is provided with a valve 14 for regulating the flow of injected liquid. The auxiliary air thus humidified is then mixed, after its passage into the channel or channels 4, with the cold and dry air which conveys the powder. The relative humidity of the said mixture is advantageously made still higher by lowering the outlet temperature of the jet of main air which carries the powder. For example, the outlet temperature of the main air carrying the powder may be lowered by about 10° to 15° centigrade by causing it to pass, before its injection into the gun, into a chamber 15 provided with a refrigerating unit, not shown in the drawing.

Generally speaking, the invention is intended to be utilized for installations for the electrostatic projection of coating powders. Although the example of application descrived above is directed to a manually-operated gun, it will be understood that the invention is equally applicable to installations provided with projectors which may be fixed or mounted on a robot.

What we claim is:

1. In a method of coating objects by projecting a stream of powder-carrying gas past electrostatically charged electrode means against said objects, the improvement which comprises the step of mixing said stream as it passes said electrode with an auxiliary stream of preheated and prehumidified gas.

2. The method claimed in claim 1 which comprises the step of reducing the temperature of the powder carrying stream before mixing it with said auxiliary stream.

3. In an electrostatic spray gun which comprises means for leading a steam of powder-carrying gas past electrostatically charged electrode means, and means for mixing said powder-carrying stream, at a pont adjacent said electrode, with a stream of auxiliary gas, the improvement which comprises means for heating and humidifying said auxiliary stream before it reaches said electrode means.

4. Spray gun as claimed in claim 3 comprising means for cooling said powder-carrying stream before it reaches said electrode means.

* * * * *